United States Patent [19]

Remington et al.

[11] Patent Number: 4,811,999

[45] Date of Patent: Mar. 14, 1989

[54] CABINET WITH PIVOTED LOCKING OUTRIGGER

[75] Inventors: John L. Remington, Coplay; Harry W. Seidel, Mertztown, both of Pa.

[73] Assignee: The Stanley Works, New Britain, Conn.

[21] Appl. No.: 783,255

[22] Filed: Oct. 2, 1985

Related U.S. Application Data

[63] Continuation of Ser. No. 576,327, Feb. 2, 1984, abandoned.

[51] Int. Cl.[4] ..... A47B 91/00

[52] U.S. Cl. ..... 312/250; 312/311; 211/4

[58] Field of Search ..... 297/310; 312/250, 275, 312/276, 253, 255, 311; 280/763.1

[56] References Cited

U.S. PATENT DOCUMENTS

| | | | |
|---|---|---|---|
| 380,045 | 3/1888 | Melton . | |
| 1,740,470 | 12/1929 | Mack . | |
| 2,607,649 | 8/1952 | Johnson . | |
| 2,857,229 | 10/1958 | Sitler . | |
| 3,371,959 | 3/1968 | Gordin | 297/310 |
| 3,393,950 | 7/1968 | Dutcher et al. . | |
| 3,893,740 | 7/1975 | England | 312/216 |
| 3,902,603 | 9/1975 | Wilson | 211/4 |
| 4,067,444 | 1/1978 | Wilson | 211/4 |
| 4,183,579 | 1/1980 | Rojas . | |
| 4,449,969 | 5/1984 | Schweizer | 248/528 |

*Primary Examiner*—Joseph Falk

*Attorney, Agent, or Firm*—Woodcock Washburn Kurtz Mackiewicz & Norris

[57] ABSTRACT

An improved tool box with a tip-over preventive outrigger attached is disclosed. The outrigger is pivoted about an axis beyond the lateral extension of the drawers on the front face of the tool box so that the outrigger must be placed in its supportive position before any of the drawers can be opened. A hasp and lock may be added for locking the outrigger in the closed position so that none of the drawers can be opened.

5 Claims, 2 Drawing Sheets

CABINET WITH PIVOTED LOCKING OUTRIGGER

This is a continuation of application Ser. No. 576,327, filed Feb. 2, 1984, now abandoned.

FIELD OF THE INVENTION

This invention relates to cabinets. More particularly, the invention relates to a tool box-type cabinet comprising a large number of sliding drawers in which a stabilizing, pivoting outrigger is provided which is foolproof—that is, it must be placed in its operative position if the drawers are to be opened—and which is additionally utilized to provide a lock for the drawers.

BACKGROUND AND OBJECTS OF THE INVENTION

The use by mechanics, plumbers and other workmen of large tool boxes or cabinets fitted with a number of horizontally slidable drawers, mounted on casters for movement about a work area, is very common. These tool boxes can be guide large, up to on the order of perhaps six feet tall, and are very heavily constructed so as to be able to contain a large amout of tools, spare parts and the like. When a drawer of such a tool box having a large number of heavy tools stored therein is pulled out, particularly to its full extension, it can occur that the center of gravity of the tool box as a whole may be vertically aligned with or even be located forward relative to the axis of its front casters, thus becoming unstable. If such an unstable tool box is then given a slight impetus to tip forward, it tends to tip very quickly as it pivots on the wheels of the casters. Moreover, of course, the fact that the box is very heavily laden means that its momentum is substantial such that it is very possible for a serious injury to result to anyone who happens to be beneath the falling tool box.

It would be a simple matter to provide an outrigger extending forward from the tool box, in the direction the drawers are opened, so as to provide a rigid strut for prevention of the tool box's tipping forward on its wheels. However, to provide such a rigid strut would not be desirable because it would be in the way, causing the box to take up additional storage space even when the tool box is not being used, and would thus be unpopular in the marketplace. Moreover, if such a stabilizing outrigger strut were to be added to preexisting tool boxes, it would be desirable if this could be done in as efficient and useful a way as possible. In particular, it would be desirable if additional improvements could be made to the tool box structure and mode of operation at the same time.

OBJECTS OF THE INVENTION

It is accordingly an object of the invention to provide an outrigger for a tool box which does not require substantial additional storage space when the tool box is not being used, and which is foolproof in the sense that the workman is not tempted or enabled to circumvent the protection thus provided him.

It is a further object of the invention to provide an outrigger for a tool box in which the outrigger added provides as many additional improvements to the tool box as possible.

Summary of the Invention

The present invention satisfies the needs of the art and objects of the invention mentioned above by its provision of a pivoting outrigger for a tool box. The outrigger pivots about a vertical axis just outside the lateral extension of the drawers of the tool box so that it folds flat across the front of the drawers. This has several advantages. Primary among these is that in order to open any drawer the outrigger must be extended, thus preventing the workman from circumventing the protection thus provided him. Moreover, a hasp can be provided for insertion of a padlock so that the outrigger can be locked across the drawers when not in use, providing a very positive lock against pilferage of tools from the tool box.

Brief Description of the Drawings

The invention will be better understood if reference is made to the accompanying drawings, in which.

Brief description of the Preferred Embodiments

Figure 1:
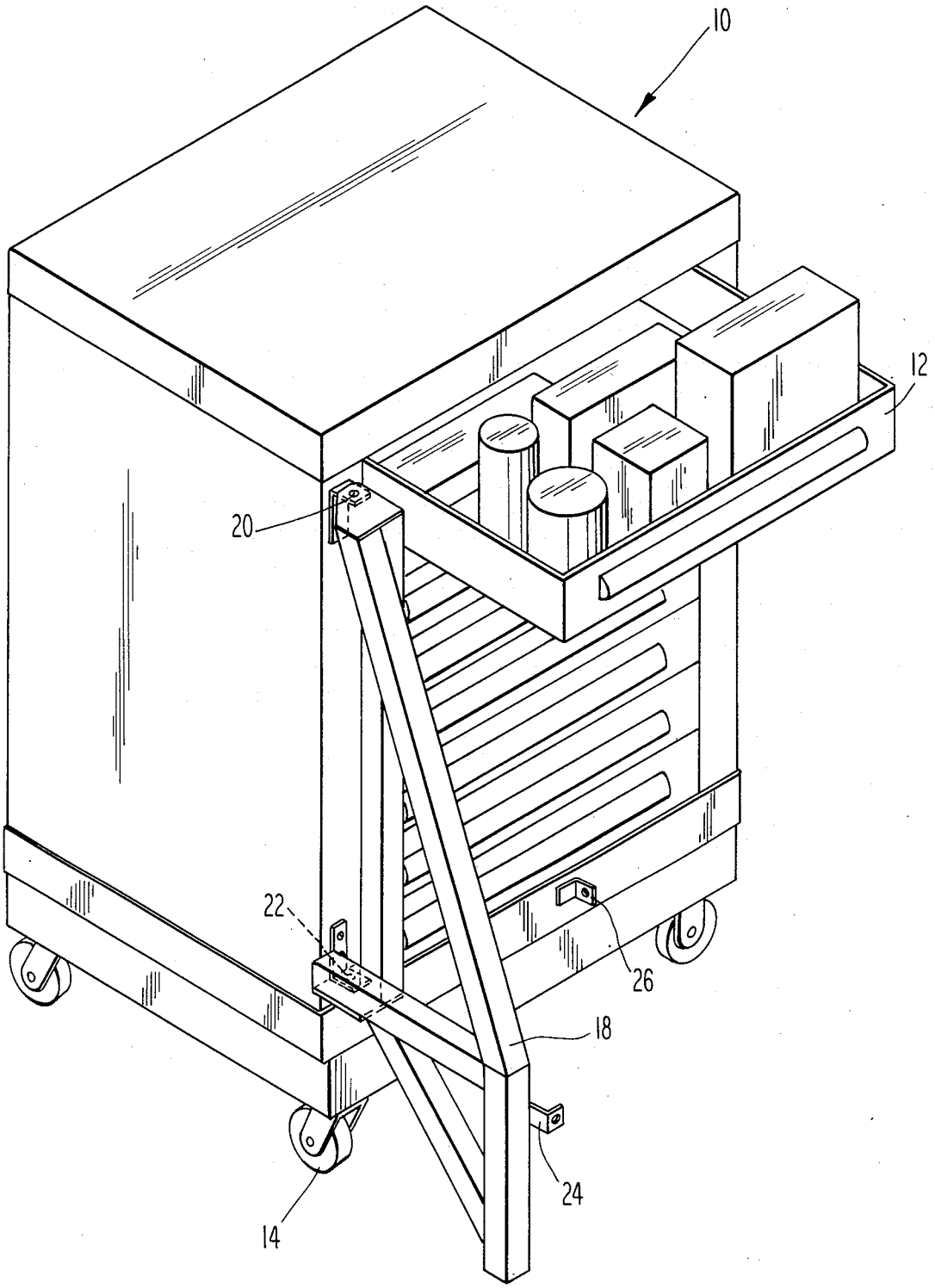
FIG. 1 shows a perspective view of the tool box according to the invention with the outrigger open.
Figure 2:
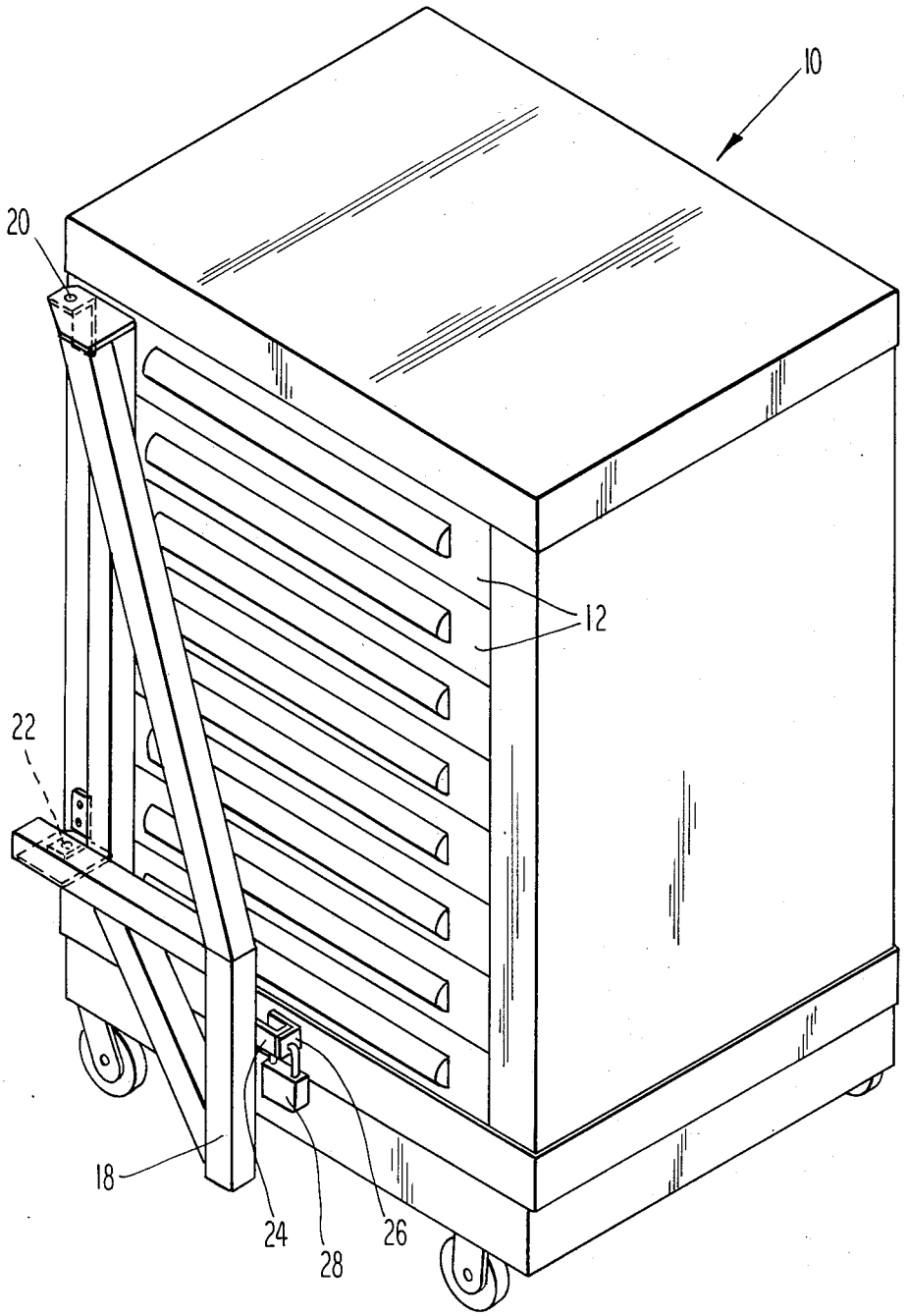
FIG. 2 shows a perspective view of the tool box according to the invention with the outrigger closed.

FIG. 1 shows a typical tool box 10 with a number of drawers 12. As indicated, the drawers are frequently full of very heavy objects, mechanics' tools and the like, and consequently when a large drawer is pulled all the way out, the center of gravity of the tool box as a whole can be vertically aligned with, or even ahead of the axis of the casters 14 at the front of the box. Hence, the box is made very unstable. According to the invention, an outrigger 18 is provided pivoted at upper and lower mounts 20 and 22, respectively, so as to be folded across the drawer when in the closed position shown in FIG. 2. Thus, when it is desired to open a drawer 12, the workman is obliged to open the outrigger 18. In this way, he is prevented from disabling this important safety feature. This is accomplished by pivoting the outrigger 18 about an axis which is beyond the lateral extension of the drawers, but still disposed in front of the tool box itself, as shown in FIG. 1. As shown by FIG. 2, when the outrigger is closed, it prevents any of the drawers from being opened by virtue of fitting flush in front of all of the drawers. An additional advantage is realized by addition of a hasp 24 to the outrigger 18 and a second hasp 26 on the chassis (i.e., not on a drawer) of the tool box 10. A lock 28 can be placed through the two hasps, thus preventing opening of any of the drawers 12 by one seeking to pilfer tools from the tool box 10.

As described above, the problem of tipping of tool boxes is particularly grave in cases where the tool box is fitted with casters 14 because the caster provides a very free rolling pivot about which the entire box can rotate, tending to fall forward. However, permanently mounted tool boxes with drawers also suffer from instability and can similarly be prevented from tipping by installation of an outrigger 18, again pivoted about a vertical axis beyond the lateral extension of the drawers and desirably fitted with hasps for insertion of a padlock 28 as shown in FIG. 2 hereof.

The construction of the outrigger according to the invention is straightforward. Its main members are steel, e.g., one-inch square tubing of 1/16 inch wall thickness and form a pivotally mounted rigid strut as shown in FIGS. 1 and 2. The remaining members can be formed of mild steel plate and welded, drilled and tapped, all as conventional in the art, as needed, to perform the functions called for.

While a preferred embodiment of the invention has been described, its scope should not be limited thereby, but only by the following claims.

In particular, use of the term "tool box" throughout does not limit the invention to cabinets used exclusively for the storage of tools.

I claim:

1. A locking and stabilizing outrigger for a cabinet of the type having a plurality of horizontally extendable drawers, comprising:

a rigid strut member mounted for pivoting between a locking position and a stabilizing position about a vertical axis beyond the lateral extension of the drawers on the face of the cabinet from which the drawers may be extended, said strut member having a width and length adequate to extend over at least a portion of each of the drawers on the face of the cabinet to prevent the drawers from being extended to open position when said outrigger is in the locking position, such that said outrigger must be pivoted outwardly into a stabilizing position prior to opening of the drawers, said strut member having a length adequate to extend at least as low as the bottom of the cabinet and having a width adequate to prevent tipping of the cabinet when one or more of the drawers is moved to open position and said outrigger is pivoted to the stabilizing position beyond the position of the drawers when the drawers are open.

2. The outrigger of claim 1 further comprising hasp and lock means for locking said outrigger across said drawers of said cabinet to prevent pilferage of goods stored therein.

3. A cabinet comprising one or more horizontally openable drawers and a locking and stabilizing outrigger means mounted for pivoting between a locking position and a stabilizing position about a vertical axis beyond the lateral extension of said drawers on the face of said cabinet from which said drawers may be extended, said outrigger means having a width and a length adequate to extend over at least a portion of each of the drawers on the face of the cabinet to prevent the drawers from being extended to open position when said outrigger means is in the locking position, such that said outrigger means must be opened to its stabilizing position prior to opening of said drawers, said outrigger means having a length adequate to extend at least as low as the bottom of the cabinet and having a width adequate to prevent tipping of the cabinet when one or more of the drawers is moved to open position and said outrigger means is pivoted to the stabilizing position beyond the position of the drawers when the drawers are open.

4. The cabinet of claim 3 wherein means are provided for locking of said outrigger across said drawers preventing them from being opened.

5. A cabinet according to claim 3 wherein said cabinet is mounted on a plurality of casters for movement about the floor of a work area, and said outrigger means extends below the bottom of the cabinet.

* * * * *